US007578152B2

(12) United States Patent
Cordes et al.

(10) Patent No.: US 7,578,152 B2
(45) Date of Patent: Aug. 25, 2009

(54) WET PROCESSING OR FINISHING MACHINE FOR ROPE-FORMED TEXTILE PRODUCTS

(75) Inventors: Carl Cordes, Schwabish Hall (DE); Thomas Widmer, Lucerne (CH)

(73) Assignee: Then Maschinen (B.V.I.) Limited, Tortola (VG)

( * ) Notice: Subject to any disclaimer, the term of this patent is extended or adjusted under 35 U.S.C. 154(b) by 724 days.

(21) Appl. No.: 10/967,303

(22) Filed: Oct. 19, 2004
(Under 37 CFR 1.47)

(65) Prior Publication Data

US 2007/0137562 A1 Jun. 21, 2007

(30) Foreign Application Priority Data

Oct. 21, 2003 (DE) ..... 103 49 374

(51) Int. Cl.
*D06B 5/08* (2006.01)

(52) U.S. Cl. ..... 68/178; 68/179

(58) Field of Classification Search ..... 68/177, 68/178, 179; 134/184, 198
See application file for complete search history.

(56) References Cited

U.S. PATENT DOCUMENTS 3,659,438 A * 5/1972 Chiba et al. ..... 68/177
3,718,012 A * 2/1973 Vinas ..... 68/9
3,966,406 A * 6/1976 Namiki et al. ..... 8/636
3,982,411 A * 9/1976 Kreitz ..... 68/177
4,019,351 A * 4/1977 Mizutani et al. ..... 68/177
4,036,038 A * 7/1977 Aurich et al. ..... 68/5 C
4,322,957 A * 4/1982 Nowicki et al. ..... 68/13 R
4,766,743 A * 8/1988 Biancalani et al. ..... 68/20
4,881,384 A * 11/1989 Chicharro ..... 68/27
4,981,025 A * 1/1991 Brazzoli ..... 68/178
5,402,659 A * 4/1995 Turner et al. ..... 68/178
6,393,871 B1 * 5/2002 Chiang ..... 68/5 D
6,427,495 B1 * 8/2002 Berlendis ..... 68/152

FOREIGN PATENT DOCUMENTS

ES 2 065 194 * 2/1995
GB 2 364 329 * 1/2001

OTHER PUBLICATIONS

European Patent Office 0 723 045 Jul. 1996.*

* cited by examiner

*Primary Examiner*—Frankie L Stinson
(74) *Attorney, Agent, or Firm*—Kratz, Quintos & Hanson, LLP

(57) ABSTRACT

A Wet processing machine for rope-formed textile product comprises a closed vessel and a Venturi-Transport jet system, which can be impinged to a transport medium current, in order to drive an endless fabric rope circulating in the vessel in a pre-determined rotation context. The transport jet system has a nozzle annular gap through which the transport medium flows, which is restricted on the one side by a nozzle cone with a passage channel. Winding devices are provided upstream of the transport jet system in the fabric rope movement path. Further, devices are available, which serve the application of a processing liquor on the fabric rope in a segment of the fabric rope movement path, which lies between the area of the winding device and the nozzle annular gap of the transport jet system.

16 Claims, 3 Drawing Sheets

WET PROCESSING OR FINISHING MACHINE FOR ROPE-FORMED TEXTILE PRODUCTS

Figure 1:
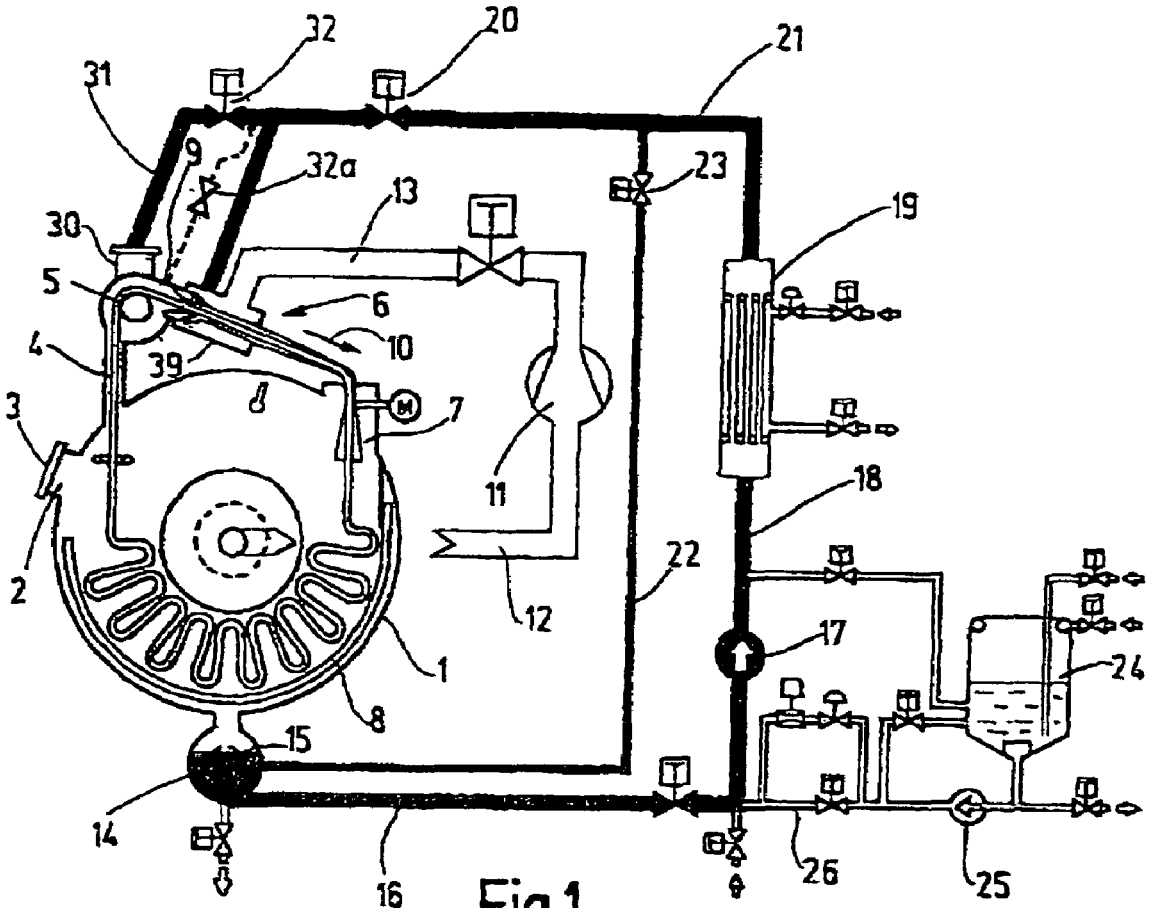

The invention relates to a Wet processing machine for rope-formed textile products with a closed vessel and a Venturi-Transport Jet System, which is impinged to the current of a transport medium, in order to drive the endless fabric rope circulating in the vessel in a given rotation direction.

In actual practice, such wet processing machines, known as Jet dyeing machines and similar ones, operate in several design forms, depending upon whether the transport medium is liquid or gaseous, in accordance with the hydraulic or aerodynamic principles. The endless fabric rope conveyed through the Transport Jet System is plaited when it exits from the Transport Jet System, through a plaiting machine and then stored in a Storage, from which it is continuously withdrawn and is fed to the fabric rope entry of the Transport Jet System. For the purpose of lifting the ropes from the Storage and its feeding into the start of the rope entry of the Transport Jet System, reel winders are allocated, generally one reel winder for each Transport Jet of the Transport jet System. The electro-motor driven reel-winder is located in the fabric rope path before the fabric rope's entry into their relevant transport jet and deflects the fabric rope lifted from the Storage, mostly moving in the vertical direction by at least 90°, before it enters the fabric rope entry of the Transport Jet. Between the Reel winder and the Storage, a portion of the processing liquor carried by the fabric rope drips on the essentially vertical section of the Fabric rope path. This action is thereby supported that the fabric rope lies on the reel winder surface with its weight and therefore is more or less pressed together.

In order to distribute the processing liquor as far as possible uniformly on the circulating fabric rope, the processing liquor is circulated through a Liquor Circulation Pump and in cooperation with current of the Transport medium, brought on the fabric-rope for the desired effect. In one of the wet processing (or finishing) machines of this type, known from EP 0078022, the processing material is added in atomized form to a gas stream, which serves as the transport medium current for the circulating fabric rope. In respect of another piece dyeing machine, which works on the basis of the aerodynamic principle, according to EP 09455381, the processing material is introduced in the Jet housing of the Transport jet, whereby the particles of the processing material is distributed by the gaseous transport medium current through the Nozzle Annular Gap uniformly on the moving fabric rope, in which process, during the transport jet's subsequent movement through the intensive stretch, they are milled.

Experience in actual practice has shown that the quantity of the liquid processing liquor, which can be sprayed in gaseous Transport Medium current, for a jet finishing machine, working on aerodynamic principle, is limited. The liquid droplets of the processing liquor brought to the Transport medium current should be accelerated in the fabric rope movement direction, for which purpose a significant Energy of the transport medium current is necessary, which must be generated through the Blower, helping this process. Particularly, during rinsing or flushing of the fabric rope, it is desirable to have a higher liquid throughput through the Transport Jet or Nozzle in order to reduce or shorten the rinsing/flushing time and to achieve a good flushing effect.

Therefore, the task of the Invention is to devise a method, which enables to improve application of the processing or finishing liquor on to the fabric rope, in a simple manner.

For solving this problem, reference is made to the characteristics of the Patent Claim 1 for the invention-based Wet Processing machine.

The new Wet processing machine is equipped with means for bringing the processing liquor on to the fabric rope on a section or segment of the fabric rope path between the area of the Reel winder and an Annular Gap of the Transport Jet system, which enables, in addition or alternatively to the existing means in the area of the Transport jet system for this purpose, to bring the processing liquor on the fabric rope to achieve the desired effect so that the fabric rope enters already loaded with the processing liquor in the area of the Nozzle Annular Gap of the Transport jet system. Because of the fact that the application of the processing liquor on the fabric rope takes place between the area of the reel winder and the nozzle annular gap, a specially effective wetting of the fabric rope before the processing of the fabric rope with the processing liquor in the Transport jet system is achieved. This is because generally the horizontal, or as against the horizontal slightly tilted path of the fabric rope, between the reel winder and the transport jet system, is relatively short with the result that the fabric rope brings in a larger portion of the processing liquid into the transport jet system. Correspondingly, the portion of the processing liquor applied to the fabric rope in the area of the transport jet system itself can be reduced.

It is purposeful, if the device of application of the processing liquor on the fabric rope are so arranged, that the processing liquor emanating from these possess at least an agitation component in the flow direction of the fabric rope. Therewith, the required energy for acceleration of the liquid droplets in the fabric rope direction is minimized, because the processing liquor applied is already accelerated in the movement direction of the fabric rope. This results in a relief to the gaseous transport medium circulation and a faster fabric rope rotation. Furthermore, the product passing through is improved, which is attributable to the fact that the liquid droplets of the processing liquor no longer impact from the right-angle on the surface of the fabric rope to the fabric rope run direction.

In actual design, the processing liquor application device, in the area of the reel winder, can have a spraying device with a spraying nozzle. This spray nozzle has, in the area of its nozzle mouth an axis, which locks in or encompasses the fabric rope run direction with an angle less than 90°.

Simpler design features can be achieved if the reel winder device has at least one winder, pivoting on a rotation axis, and the processing liquor application device for instance, open out in an area upper half of the winder, so that the exiting processing liquor flows downwards and impacts on the fabric rope moving by. Alternatively and/or additionally, the processing liquor application device can also open out in an area lying between the axis of the winder and a nozzle cone or taper of the Transport jet system, if this is possible in the context of the design practices.

The new wet processing machine can also have additionally or alternatively, devices for injection of a processing liquor in the passage channel of the nozzle cones, which open out to the channel wall, limiting the passage channel all around. Through this injection device, the processing liquor, that means, the processing substance is brought on to the fabric rope passing through the transport nozzle separately from the Transport medium current. Also here, the impacting of the fabric rope with the processing liquor is independent of the speed of the Transport medium current flowing in the annular gap, which brings about the conveyance/transport of the product. Because of the fact that the injection device is arranged in the area of the nozzle cone, the fabric rope is already pre-treated with the processing liquor emanating from the injection device, if the fabric rope enters the annular gap and there it is impacted with the transport medium. As the injection device is distributed around the passage channel wall, the fabric rope passes through a processing liquor curtain, during movement through the passage channel of the nozzle cones. Because of this, a very soft impacting of the product with the processing liquor takes place, which is arranged concentrically around the nozzle opening.

As already mentioned, in a preferred design form, the injection device converge with reference to the longitudinal central axis of the passage channel in such a manner, that the processing liquor flowing from it into the passage channel has an agitation component in the product flow direction. For this purpose, the injection devices are arranged so that they converge advantageously under an angle with the longitudinal central axis and its vertex pointing to the product flow direction. Through these measures, what is achieved is that the above referred to processing liquor curtainA, has a component directing to the product flow direction, which can be so enlarged, that it has nearly the speed of the passing fabric rope. As a consequence, the processing liquor, fed through the injection device into the passage channel, as mentioned, need not be accelerated initially by the through-moving fabric rope, which would have led to a braking effect on the product fabric rope. In a preferred design form, the injection device has injection channels distributed around the channel wall, and converging in the passage channel, whereby their converging throughout the circumference of the passage channel is ideally distributed uniformly. Alternatively or additionally, the injection device could have at least one annular gap penetrating and surrounding all around the wall of the passage channel, which encompasses the passing fabric rope and brings the processing liquor uniformly on the fabric rope.

In either of the case however, a very soft impacting of the fabric rope takes place, as already mentioned. The required milling or massaging of the processing liquor in the product takes place through the transport medium current during passage of the fabric rope through the subsequent intensive path of the transport nozzle, which extends itself from the annular gap in the product flow direction. Through the injection of the processing liquor in the nozzle cone, it is not necessary for the processing liquor to be deflected; it lands directly and 100% on the through-going product stream, because no spilling or scattering of the liquid particles takes place; this could not have been avoided if the processing liquor was facing the transport medium current.

It is possible to encircle the transport nozzle in the customary manner with its own nozzle housing in the area of the annular gap, which is connected through a corresponding line with the transport medium source. Especially in respect of the so-called multi-storage machines, in which several transport jets, side by side, are allotted to a single vessel, the arrangement can be made in such a manner that the transport nozzle of the jet system are located together with their annular gaps in a common transport medium distribution chamber, impinged to the gaseous transport medium. This distribution chamber can be designed purposefully as a longitudinal transport medium distribution box, connected to the transport medium source, in which the transport nozzles are directly placed.

Further developments of the invention are the object of sub-claims. A design example of the object of the invention is illustrated in the drawing. It shows:

FIG. 1 a wet processing/finishing machine as per invention in form of a piece-dyeing machine, in cross section in a schematic side view.

Figure 2:
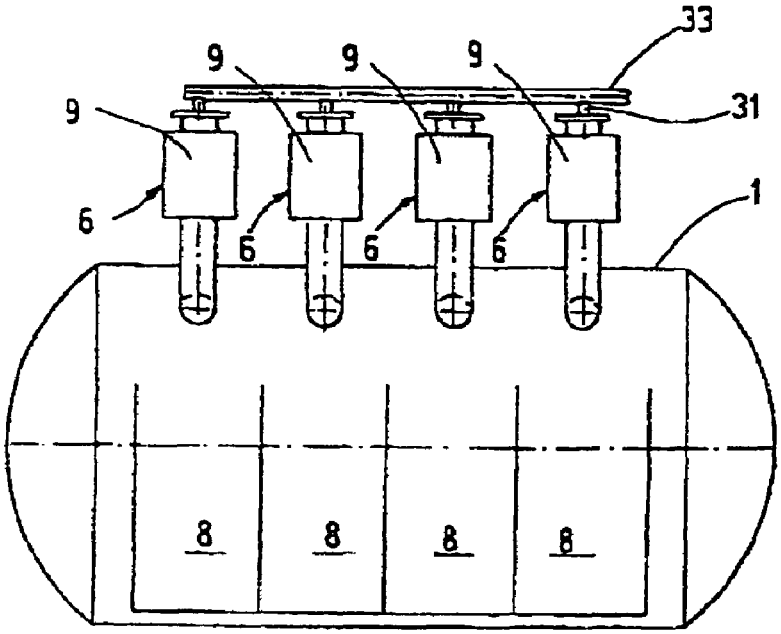

FIG. 2 the Processing vessel of the piece dyeing machine, according to FIG. 1, in a side view without all auxiliary devices.

Figure 3:
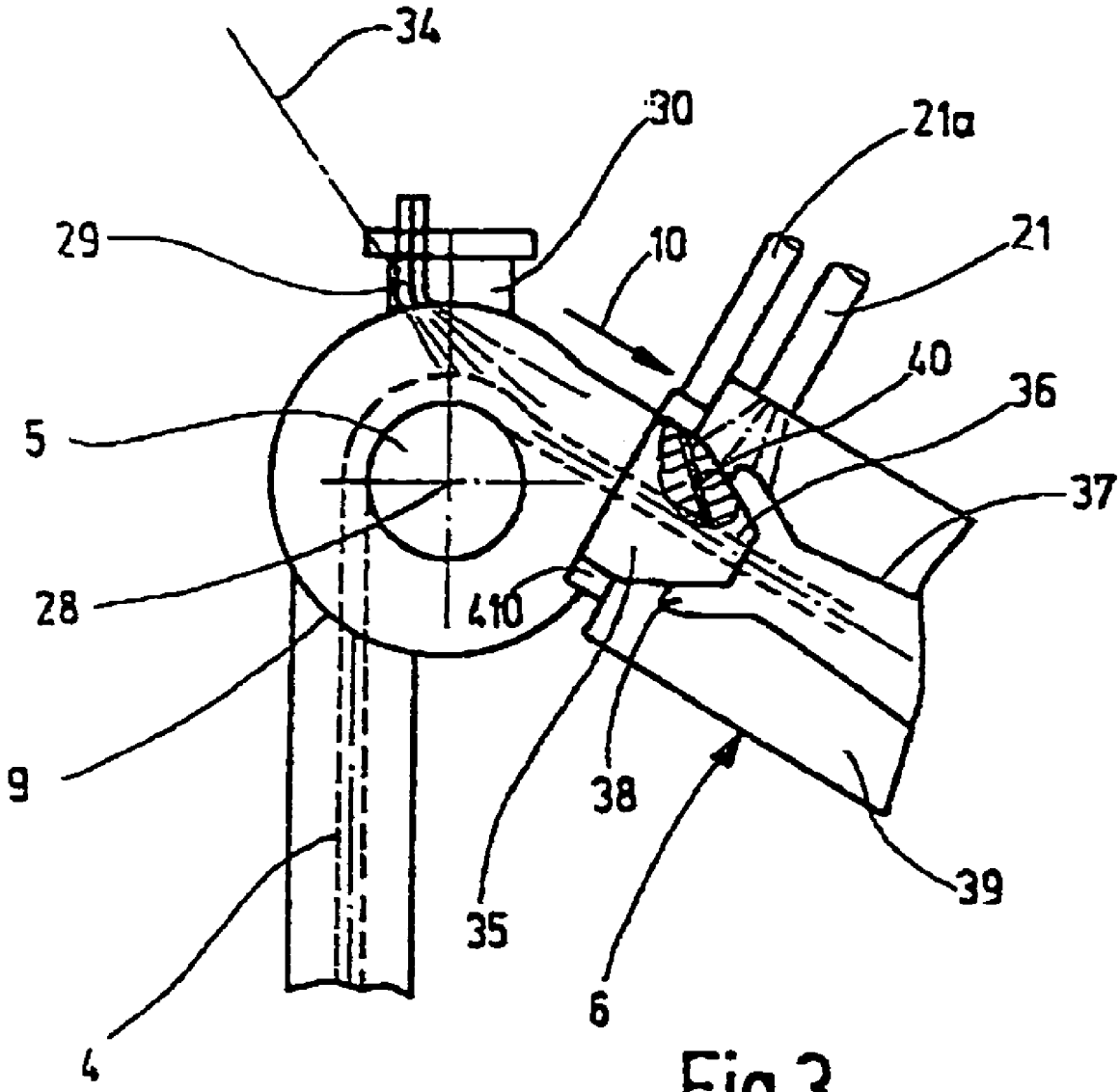

FIG. 3 A Venturi-Transport jet of the piece dyeing machine according to FIG. 1, in Section in an enlarged scale, and in a side view, partially in sections.

Figure 4:
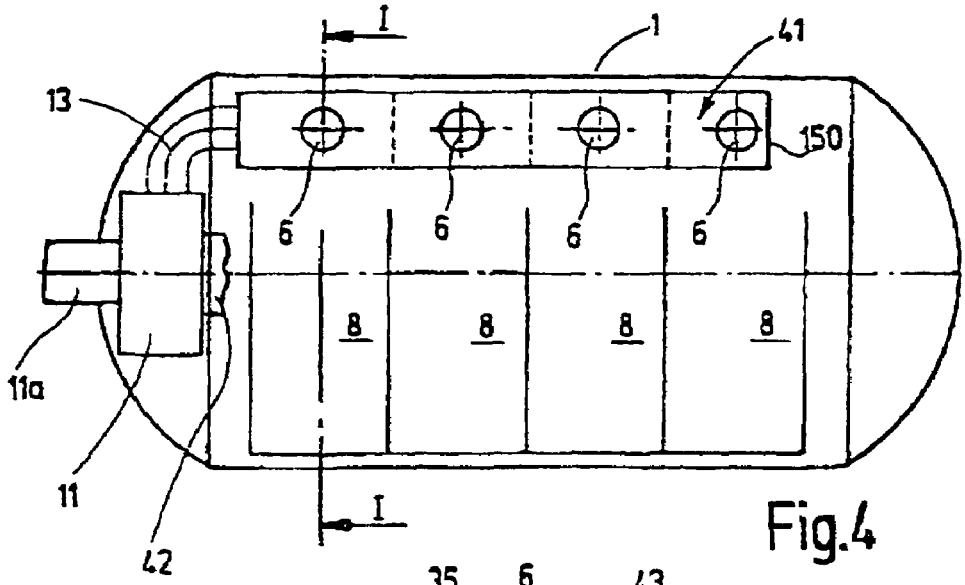

FIG. 4 The processing vessel of a piece dyeing machine as per invention, in a modified design form in longitudinal view, in a side view and in schematic illustration.

Figure 5:
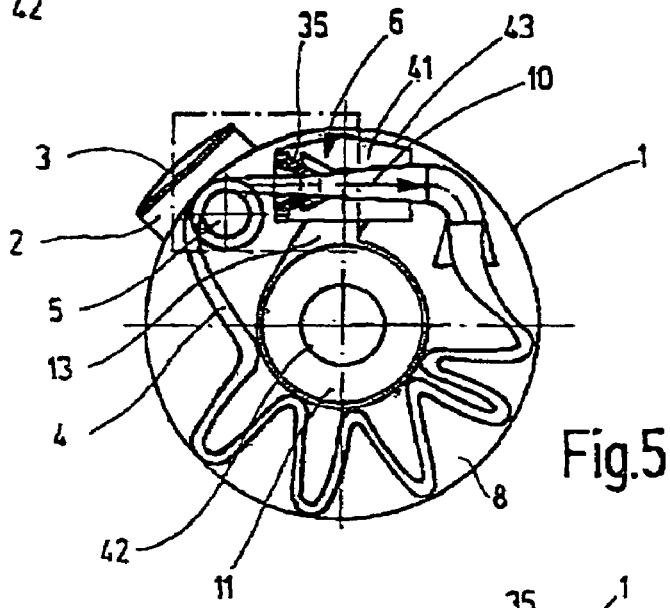
Figure 6:
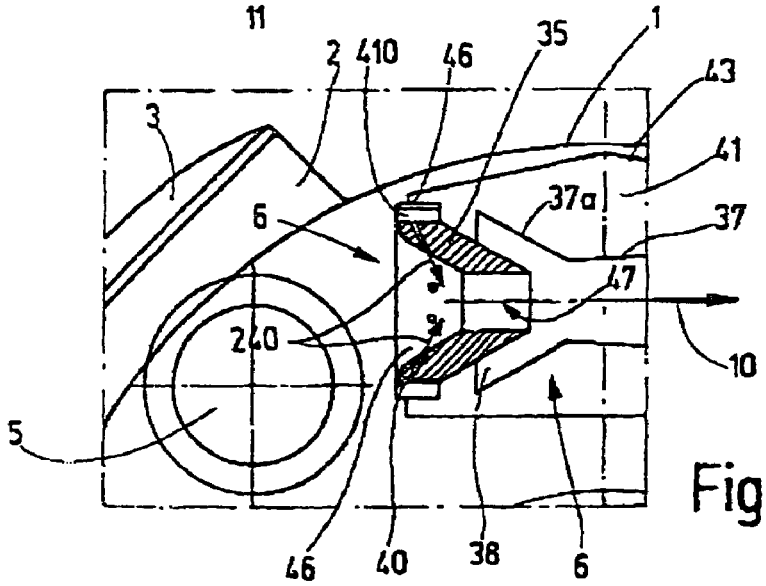

FIG. 5 the arrangement according to FIG. 4, cut longitudinally along the line V-V of FIG. 4 in a side view and FIG. 6 a section of FIG. 5 for elucidation of the product entry area of the transport jet, described in FIG. 5.

The High Temperature (HT)-Piece dyeing machine, schematically illustrated in FIG. 1, has a pressure-proof cylindrical vessel 1, in which there is an opening 3 for operational purposes, which is closeable with a lid 2, through which fabric rope 4 can be brought in. The fabric rope 4 is led through an externally-driven Winder 5 in a Venturi-Transport jet 6, to which a Plaiter 7 is connected. The Plaiter 7 places the fabric rope 4 emerging from the Transport jet 6 plaited in a Storage 8, from which the endless fabric rope is pulled out through the Winder 5 again. Thereby, the fabric rope 4, as can be seen from FIG. 1, follows a primarily vertical path between Storage 8 and the Winder 5. The Winder 5 and the Transport Jet 6 are placed in the Housing part 9, which has a leak-proof connection to the Vessel 1. The Fabric rope 4 would be tied, after bringing it in through the Opening 3, to its ends in order to build an endless product Loop.

The Transport jet 6 is impinged with a gaseous Transport medium current, which places the passing fabric rope 4 in rotation movement, as illustrated through Arrow 10. The Transport medium in the above case is air or air-steam compound, which is sucked through a Blower 11 and a Suction Pipe 12 from the Vessel 1 and conveyed through a Discharge Pipe 13 in the Transport jet 6.

In the Vessel 1, a Liquor Sump 14 is provided at the bottom, which includes a Liquor strainer 15 and which is connected to a suction pipe 16 of a Liquor Circulation Pump 17, the discharge pipe 18 of which includes a heat exchanger 19, and through a regulation valve 20 and a Pipe 21, converges in the Transport jet 6. The Liquor Circulation Pump 17 enables the processing/finishing liquor sucked from vessel 1 to be circulated through the Transport Jet 6 and Vessel 1. The Circulation path is indicated in FIG. 1 (in black colour). Parallel to the Heat exchanger 19 and the Liquor Circulation Pump 17, lies a Bypass pipe 22, which includes a shut off valve 23, and joins the Sump 14 with the discharge pipe 21.

Finally, a make-up material container 24 is also visualized, which contains in watery solution, emulsion or dispersion, a chemical processing material, which can be supplied through a processing material pump 25 and a linking pipe 26 to the suction pipe 16 of the Liquor circulation pump 17. As can be seen from FIG. 2, the piece dyeing machine is designed as a multi-storage machine, which in the above mentioned case, consists of four Storages 8 placed one after the other in the axial direction of the cylindrical vessel 1. Each one of the Storage 8 is provided with a Transport Jet 6. The four Transport jets 6 represent a Transport Jet System. In this Jet system, each Transport jet 6, is allocated with a geared winder 5, as can be clearly seen in FIG. 1, whose drive system individually is not illustrated. The Winder 5 with its drives and housing 9 makes for the winding device.

The hitherto described piece dyeing machine working in accordance with the aerodynamic principle is per se known.

In accordance with the invention, additional devices for this piece dyeing machine are planned, in order to bring the processing liquor on the fabric rope 4 in the area of the winding device.

For this purpose, the Winder 5, in the upstream of each of the transport jet 6 in the fabric rope flow direction, pivoting around a rotation axis 28 in housing 9, is allotted with a processing liquor nozzle 29 (FIG. 3), which is positioned in a connecting sleeve 30 of the housing 9. The processing liquor nozzle 29, designed where applicable as spray nozzle or injection nozzle, through a pipe 31 (FIG. 1) and a control valve 32 is connected with the processing liquor discharge pipe 21. As can be seen from FIG. 2, in the above mentioned cases, the pipes 31 leading to the four transport jets 6 are connected in parallel to a collective pipe 33, which in turn is connected to the discharge pipe 21.

FIG. 3 shows that the processing liquor nozzle 29 in the area of its convergence from vertical direction is bent to align approximately with the fabric rope passage direction 10 in such a manner, that the nozzle convergence axis 34, with the fabric rope transport direction 10, encloses a vertex, the angle point of which lies in front of the fabric rope direction. What is achieved thereby is that the processing liquor exiting from nozzle 29 has an agitation component in the movement direction 10 of the fabric rope 4.

As denoted in FIG. 3, the transport jet 6 has a nozzle cone 35 with a co-axial passage channel 36 for the fabric rope 4, to which, in the fabric rope flow direction, a diffuser 37 connects up, which creates, together with the nozzle cone 35 an annular gap 38. The annular gap 38 is positioned in a surrounding tube-formed nozzle housing 39, in which the processing liquor discharge pipe 21 (not illustrated in FIG. 3) and the blower-discharge pipe 13 converge.

The convergence of the discharge pipe 21 for the processing liquor in the nozzle housing 39 takes place (a convergence not further illustrated in detail in FIG. 3) such that it can be similarly aligned in the rotation direction 10 of the fabric rope 4, and from which the liquid droplets of the injected processing liquor from the transport medium current can be brought in the annular gap 38.

Alternatively or additionally to the injection or discharge pipe 21 converging in the nozzle housing .39, the arrangement can also be such, as illustrated in FIG. 3, that the injection channels 40 are provided in the nozzle cone 35, which distributed uniformly around the passage channel 36, converge in these. The injection channels 40 as can be seen from FIG. 3, with their central axis counter to the product flow direction 10 are arranged with a tilt in such a manner, that the processing liquor sprays emerging from them have an agitation component in the rope flow direction 10. Evidently, the axes of the injection channels 40 (of which only one is illustrated) encloses, with the axis of the passage channel 36, an angle smaller than 90°.

The injection channels 40 branch from a ring channel 410, placed on the nozzle cone 35, which is connected through a pipe 21*a* with the discharge pipe 21 of the liquor circulation pump 17.

In operation, the processing liquor circulated on the circulation path illustrated in black colour in FIG. 1, to which where applicable, special processing additives from the make-up material container 24, for instance, dyes, are added, and which is brought up to the respectively required processing temperature in the heat exchanger, is injected through the discharge pipe 21 in the nozzle housing 39 of each of the transport jets and using the transport medium current, is brought on the passing fabric rope 4. Simultaneously, the processing liquor is brought on the fabric rope 4 through pipe 21 and the nozzle 29 in the area of the respective winder 5 before it runs into the nozzle cone 35. The splitting of the processing liquor between the nozzle housing 39 and the processing liquor nozzle 29 can be adjusted with both the regulating valves 22, 32 (FIG. 1). As already mentioned, additionally or alternatively, processing liquor can be brought on the fabric rope also through the pipe 21*a* of FIG. 3 and through the injection channel 40.

While in the described design model, the processing liquor nozzle 29 converges upper half of the winder 5, the arrangement can also be such that the convergence of the processing liquor nozzle 29 happens in the area between the rotation axis 28 of the winder 5 and the fabric rope entry in the nozzle cone 35. This is possible through a pipe 31*a,* schematically denoted in dotted line in FIG. 1, which includes a regulation valve 32*a*. It is also possible to think of applying the processing liquor on the fabric rope before its entry in the nozzle cone 35 flatly distributed or at several places in the section between the rotation axis 28 and the nozzle cone 35.

In the FIGS. 4 to 6, a further example of a wet processing machine according to the invention is explained in the form of a High Temperature (HT)-piece dyeing machine based on aerodynamic principle, of which in FIG. 4 mainly the vessel 1 is illustrated, which is designed as a closed cylindrical pressure vessel. The machine is a so-called multi-storage machine and has again four Venturi-Transport jets 6, which are arranged in the vessel 1 in axial direction, one after the other. The Winder 5 provided for each of the transport jets 6 is in this context arranged in such a manner, that primarily a horizontal path of the fabric rope 4 emerges between the Winder 5 and the transport jet 6.

Using the FIGS. 1 to 3 identical components are marked with identical reference numbers and are not explained once more. Components, which are not significant for the invention, are not illustrated in the figures. For details, reference for instance, is also made to EP 0945 538 A1.

The drive of the fabric rope 4 in the respective transport jet 9 happens through its being impinged with a gaseous transport medium; that is, generally Air, Steam or an Air-Steam compound. For this purpose, the blower level is provided in the face or front side of the vessel, which is driven through an electromotor 11*a,* and possesses a compressed air channel 13, which converges in a transport medium distribution box 41, extending over the axial length of the four Storages (3). The blower 11 is connected at the suction side with suction pipe 42, which is co-axial to the cylindrical vessel 1, and which extends itself over the axial length of the vessel 1 and has on its wall a corresponding perforation.

The transport medium-distribution box 41 is closed on one face side 150 and connected on its opposite face side to the compressed air channel 13 of the blower 11. It has a primarily rectangular structure (compare FIG. 2). Its upper roof wall 43 is designed, for matching with the curvature of the casing or shell of the vessel 1, in the form of a roof.

In the Transport Medium Distribution Box 41, there are four Transport jets 6, which are assembled axis-parallel one after the other, as illustrated particularly in FIG. 5, 6. Each transport jet 6 has a jet cone 35, which limits the co-axial annular gap 38, using a portion of the co-axial diffuser 37, extended to yarn trap 37*a,* through which the transport medium flows in a uniformly distributed manner in the diffuser 37. The nozzle cone 35 includes the co-axial passage channel 36 for the fabric rope 4, whereby the passage channel 36 is made of a cylindrical part 45 and a co-axial part 46, which creates the entry for the fabric rope and extends itself in the form of a filter, to which the cylindrical part 45 is connected.

As can be seen from FIG. 5, the Transport jets 6 in the Transport Medium Distribution Box 41 are placed with horizontally oriented nozzle longitudinal axis, in such a manner, that their nozzle cone 35 and their diffuser 37 penetrate the opposite box side walls 46 respectively insulating each other.

In operation, the space covered by the Transport-Medium-Distribution box 41, in which the annular gap 38 of the transport jet 6 are located, impinged by the blower 11 with transport medium, so that all four transport jets 6 convey their respective fabric rope 4 uniformly. The transport-medium-distribution box 41, with the transport jet 6 incorporated, works according to the so-called Common-Rail-Principle and enables to guarantee a highly uniform flow of the transport medium to all the transport jets.

As can be seen particularly from FIG. 6, the nozzle cones 35 of each of the devices transport jet 6 are provided with devices for injection of a processing liquor in the passage channel 36; these devices, as denoted through arrow 240, are uniformly distributed around the wall of the passage channel 36 and converge all around the circumference. The injection devices have injection channels 40, which are provided in the nozzle cone 35 and converge in section 46 of the passage channel 36 expanding itself into a filter form. As already mentioned, the convergence of the injection channels 40 is, circumferentially, uniformly distributed over the passage channel wall. FIG. 6 shows that the injection channels with reference to the nozzle longitudinal central axis 47 is so inclined that their axes, with the longitudinal central axis 47 respectively, covers an angle, whose angle point shows the fabric rope movement direction 10. On the side opposite their convergence, the injection channels are connected with the inner space of the ring channel 410 attached to a nozzle cone 35 and surrounding it, which is connected to the pipe 21*a* of the FIG. 3, which is not further illustrated.

The processing liquor entering the passage channel of the nozzle cone 35 from the injection channels 40, at the time of its exit from the injection channels 40, is brought in intimate contact with the passing fabric rope 4. Because the injection channels 40 are arranged inclined against the nozzle longitudinal axis in the product flow direction, also here the processing liquor exiting from the injection channels possesses an agitation component in the product flow direction, and thus supports the fabric rope transport. The impinging of the ring channels 410 with the processing liquor takes place under a pressure, which is so chosen, that the speed of the components of the processing liquor entering into the passage channel 36, indicating or pointing to the direction of the product flow 10, is somewhat similar to the flow speed of the product rope 4. Depending upon the respective process-related conditions, however, the speed of the agitation components could be however, even larger or smaller.

Alternatively, the injection channels 40 can be substituted also through a surrounding annular gap, which remains connected to ring channel 410. Also design versions are conceivable, in which, several adjacent rows of injection channels 40 and/or several correspondingly placed annular gaps are provided. in the direction of the axis of the passage channels 36.

Principally, there is also the possibility to arrange the injection channels or annular gaps in the cylindrical section 45 of the passage channel 36, about which reference is made here only for the sake of order.

Also in this design form, similar as in the case of FIG. 1, further devices for application of the processing liquor on the fabric rope can be visualized, which converge in the segment of the product flow path between the reel winder and the nozzle cone 35. Moreover, the reel winder 5 is incorporated directly in the area of the opening 2 in the vessel 1, as FIG. 6 illustrates.

In conclusion it may be mentioned that the invention is not restricted to application in respect of a wet processing machine, based on aerodynamic principle. It can also be used for jet-wet processing machines, which work with a liquid transport medium.

The invention claimed is:

1. A wet processing machine for rope-formed textile products, comprising:

a closed vessel;

a venturi transport jet system arranged to be impinged with a transport medium, for the purpose of driving an endless fabric rope in the vessel in a prescribed rotation context, the venturi transport jet system having a nozzle annular gap through which the transport medium current flows, the nozzle annular gap having, at an entry end, a nozzle cone disposed therein, having a passage channel;

a reel winding device, pre-arranged in the venturi transport jet system in the product flow direction, and through which the respective fabric rope can be guided into the venturi transport jet system; and devices for application of a processing liquor on the fabric rope in a segment of the fabric rope movement path which lie between the area of the reel winding device and the nozzle annular gap of the transport jet system, wherein the devices for application of the processing liquor in the area of the winding device converge through spraying devices including a spray nozzle, and the spray nozzle has a convergence axis in the area of nozzle convergence, which encloses with the product flow direction at an angle smaller than 90°.

2. The machine according to claim 1, wherein application devices of the processing liquor on the fabric rope are so arranged, that the processing liquor going out from them has at the minimum, an agitation component in the flow direction of the fabric rope.

3. The machine according to claim 2 including a transport medium distribution chamber, which can be impinged to a gaseous transport medium, and the venturi transport jet with its annular gap is arranged such that it lies in said distribution chamber.

4. The machine according to claim 3, including several venturi transport jets and all venturi transport jets with their annular gap are arranged such that they lie horizontally in a common distribution chamber.

5. The machine according to claim 1, wherein the reel winding device has at least one winder, capable of pivoting around a rotation axis, and the processing liquid application devices converge in an area of an upper-half of the winder.

6. The machine according to claim 1, wherein the winding device has a winder surrounding a rotary axis and the devices for application of the processing liquor converge in an area lying between the rotary axis and the nozzle cone of the venturi transport jet system.

7. A wet processing machine for rope-formed textile products, comprising:

a closed vessel;

a venturi transport jet system arranged to be impinged with a transport medium, for the purpose of driving an endless fabric rope in the vessel in a prescribed rotation context, the venturi transport jet system having a nozzle annular gap through which the transport medium current flows, the nozzle annular gap having, at an entry end, a nozzle cone disposed therein, having a passage channel;

a reel winding device, pre-arranged in the venturi transport jet system in the product flow direction, and through which the respective fabric rope can be guided into the venturi transport jet system;

a device for application of a processing liquor on the fabric rope in a segment of the fabric rope movement path which lies between the area of the reel winding device and the nozzle annular gap of the transport jet system; and a device for injection of the processing liquor in the passage channel of the nozzle cone, which converges with a channel wall restricting the passage channel all around.

8. The machine according to claim 7, wherein the injection device with reference to a longitudinal central axis of the passage channel converges in such a manner that the processing liquor entering from it into the passage channel possesses an agitation component in the product flow direction.

9. The machine according to claim 8, wherein injection devices are provided, such that they converge under an angle with the longitudinal central axis, whose angle point indicate the product flow direction.

10. The machine according to claim 7, wherein the injection devices have injection channels which converge, distributed all around the channel wall, in the passage channel.

11. The machine according to claim 10, wherein the injection channels converge uniformly over the circumference of the passage channel.

12. The machine according to claim 7, wherein the injection devices have at least one circulating annular gap, encircling and penetrating the wall of the passage channel.

13. The machine according to claim 7, wherein the passage channel of the nozzle cone has a section which extends in the form of a filter, acting as an entry filter for the fabric rope, and that the injection devices are provided such that they converge in the area of said nozzle cone section.

14. The machine according to claim 7, wherein, on the nozzle cone, there is a distribution chamber impinged to the processing liquor with which the injection devices are connected.

15. The machine according to claim 14, wherein the distribution chamber is formed through a ring channel placed on the nozzle cone.

16. The machine according to claim 14, wherein the distribution chamber is formed as a longitudinal transport-medium distribution box, which is connected to a transport medium source, and in which the venturi transport jets are directly placed.

* * * * *